United States Patent [19]

Havel

[11] Patent Number: 4,705,406

[45] Date of Patent: Nov. 10, 1987

[54] ELECTRONIC TIMEPIECE WITH PHYSICAL TRANSDUCER

[76] Inventor: Karel Havel, P.O. Box 66, Station M, Toronto, Ontario, Canada, M6S 4T2

[21] Appl. No.: 926,511

[22] Filed: Nov. 3, 1986

Related U.S. Application Data

[62] Division of Ser. No. 817,114, Jan. 8, 1986, Pat. No. 4,647,217.

[51] Int. Cl.[4] ..... G04B 47/00

[52] U.S. Cl. ..... 368/10; 368/11; 368/82

[58] Field of Search ..... 368/10–12, 368/82, 223, 239

[56] References Cited

U.S. PATENT DOCUMENTS

| | | | |
|---|---|---|---|
| 3,763,647 | 10/1973 | Shibana | 368/235 |
| 4,086,514 | 4/1978 | Havel | 313/500 |
| 4,451,157 | 5/1984 | Reap | 368/11 |

FOREIGN PATENT DOCUMENTS

| | | | |
|---|---|---|---|
| 2274966 | 9/1976 | France | 368/11 |
| 54-19788 | 2/1979 | Japan | 368/11 |
| 1528178 | 11/1978 | United Kingdom . | |
| 1569516 | 6/1980 | United Kingdom . | |

*Primary Examiner*—Vit W. Miska

[57] ABSTRACT

A timepiece includes a variable color display for indicating time in digital format and a physical transducer for measuring values of a physical quantity. The color of the display may be controlled in a plurality of steps in accordance with the output of the physical transducer.

11 Claims, 22 Drawing Figures

ELECTRONIC TIMEPIECE WITH PHYSICAL TRANSDUCER

CROSS-REFERENCE TO RELATED APPLICATIONS

This is a division of my copending application Ser. No. 817,114, filed on Jan. 8, 1986, entitled Variable Color Digital Timepiece, now U.S. Pat. No. 4,647,217.

BACKGROUND OF THE INVENTION

1. Field of the Invention

This invention relates to timepieces utilizing variable color digital display.

2. Description of the Prior Art

A display device that can change color and selectively display characters is described in my U.S. Pat. No. 4,086,514, entitled Variable Color Display Device and issued on Apr. 25, 1978. This display device includes display areas arranged in a suitable font, such as well known 7-segment font, which may be selectively energized in groups to display all known characters. Each display area includes three light emitting diodes for emitting light signals of respectively different primary colors, which are blended within the display area to form a composite light signal. The color of the composite light signal can be controlled by selectively varying the portions of the primary light signals.

Timepieces with monochromatic digital display are well known and extensively used. Such timepieces, however, have a defect in that they are capable of indicating only values of time. They are not capable of simultaneously indicating values of time and values of another quantity.

SUMMARY OF THE INVENTION

It is the principal object of this invention to provide a variable color digital timepiece in which color of the display may be controlled in accordance with a physical quantity such as temperature or atmospheric pressure.

In summary, electronic timepiece of the present invention is provided with a variable color display for indicating time in a character format. The timepiece also includes a physical transducer for measuring a physical quantity and for developing output electrical signals related to values of the measured quantity. Color control circuits are provided for controlling color of the display in accordance with the output electrical signals of the physical transducer.

BRIEF DESCRIPTION OF THE DRAWINGS

In the drawings in which are shown several embodiments of the invention.

Throughout the drawings, like characters indicate like parts.

DESCRIPTION OF THE PREFERRED EMBODIMENTS

Figure 1:
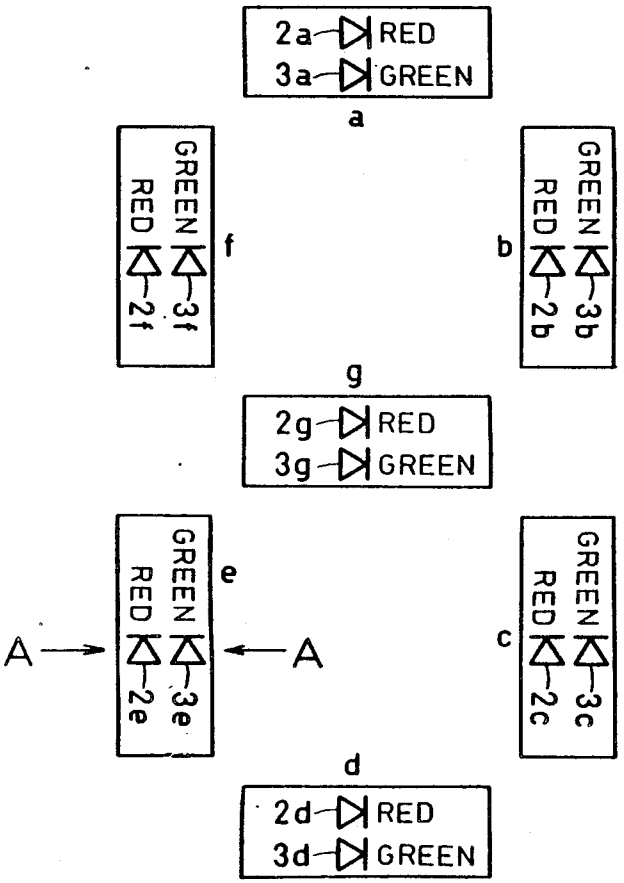
FIG. 1 is an enlarged detail of one digit of 2-primary color digital display.

Referring now, more particularly, to the drawings, in FIG. 1 is shown a 2-primary color display element including seven elongated display segments a, b, c, d, e, f, g, arranged in a conventional pattern, which may be selectively energized in different combinations to display desired digits. Each display segment includes a pair of LEDs (light emitting diodes): a red LED 2 and green LED 3, which are closely adjacent such that the light signals emitted therefrom are substantially superimposed upon each other to mix the colors. To facilitate the illustration, the LEDs are designated by segment symbols, e. g., the red LED in the segment a is designated as 2*a*, etc.

Figure 2:
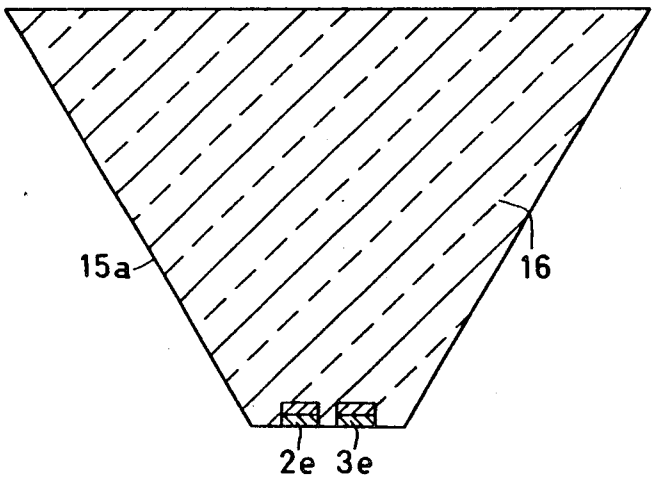
FIG. 2 is an enlarged cross-sectional view of one display segment in FIG. 1, taken along the line A—A.

In FIG. 2, red LED 2*e* and green LED 3*e* are placed on the base of the segment body 15*a* which is filled with transparent light scattering material 16. When forwardly biased, the LEDs 2*e* and 3*e* emit light signals of red and green colors, respectively, which are scattered within the transparent material 16, thereby blending the red and green light signals into a composite light signal that emerges at the upper surface of the segment body 15*a*. The color of the composite light signal may be controlled by varying portions of the red and green light signals.

Figure 3:
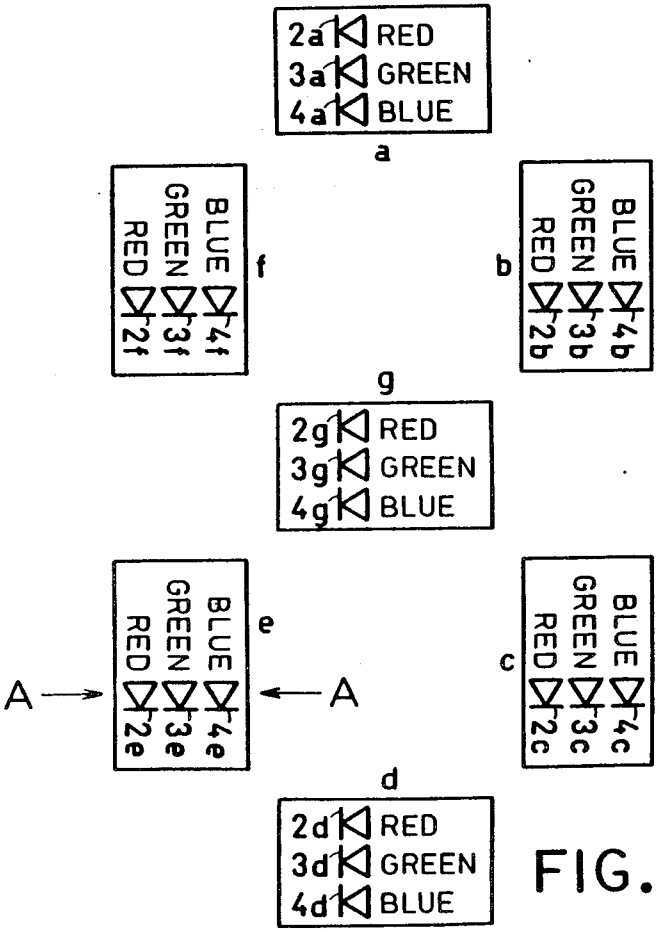
FIG. 3 is an enlarged detailed of one digit of 3-primary color digital display.

In FIG. 3, each display segment of the 3-primary color display element includes a triad of LEDs: a red LED 3, green LED 3, and blue LED 4, which are closely adjacent such that the light signals emitted therefrom are substantially superimposed upon one another to mix the colors.

Figure 4:
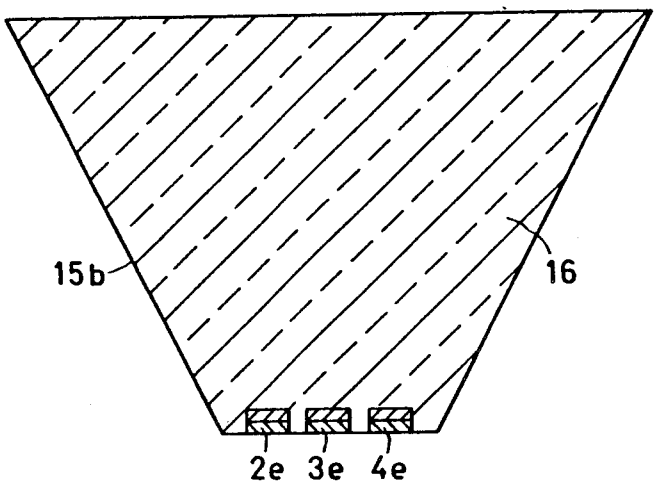
FIG. 4 is an enlarged cross-sectional view of one display segment in FIG. 3, taken along the line A—A.

In FIG. 4, red LED 2*e*, green LED 3*e*, and blue LED 4*e* are placed on the base of the segment body 15*b* which is filled with transparent light scattering material 16. Red LEDs are typically manufactured by diffusing a p-n junction into a GaAsP epitaxial layer on a GaAs substrate; green LEDs typically use a GaP epitaxial layer on a GaP substrate; blue LEDs are typically made from SiC material.

When forwardly biased, the LEDs 2*e*, 3*e*, and 4*e* emit light signals of red, green, and blue colors, respectively, which are scattered within the transparent material 16, thereby blending the red, green, and blue light signals into a composite light signal that emerges at the upper surface of the segment body 15*b*. The color of the composite light signal may be controlled by varying portions of the red, green, and blue light signals.

Figure 5:
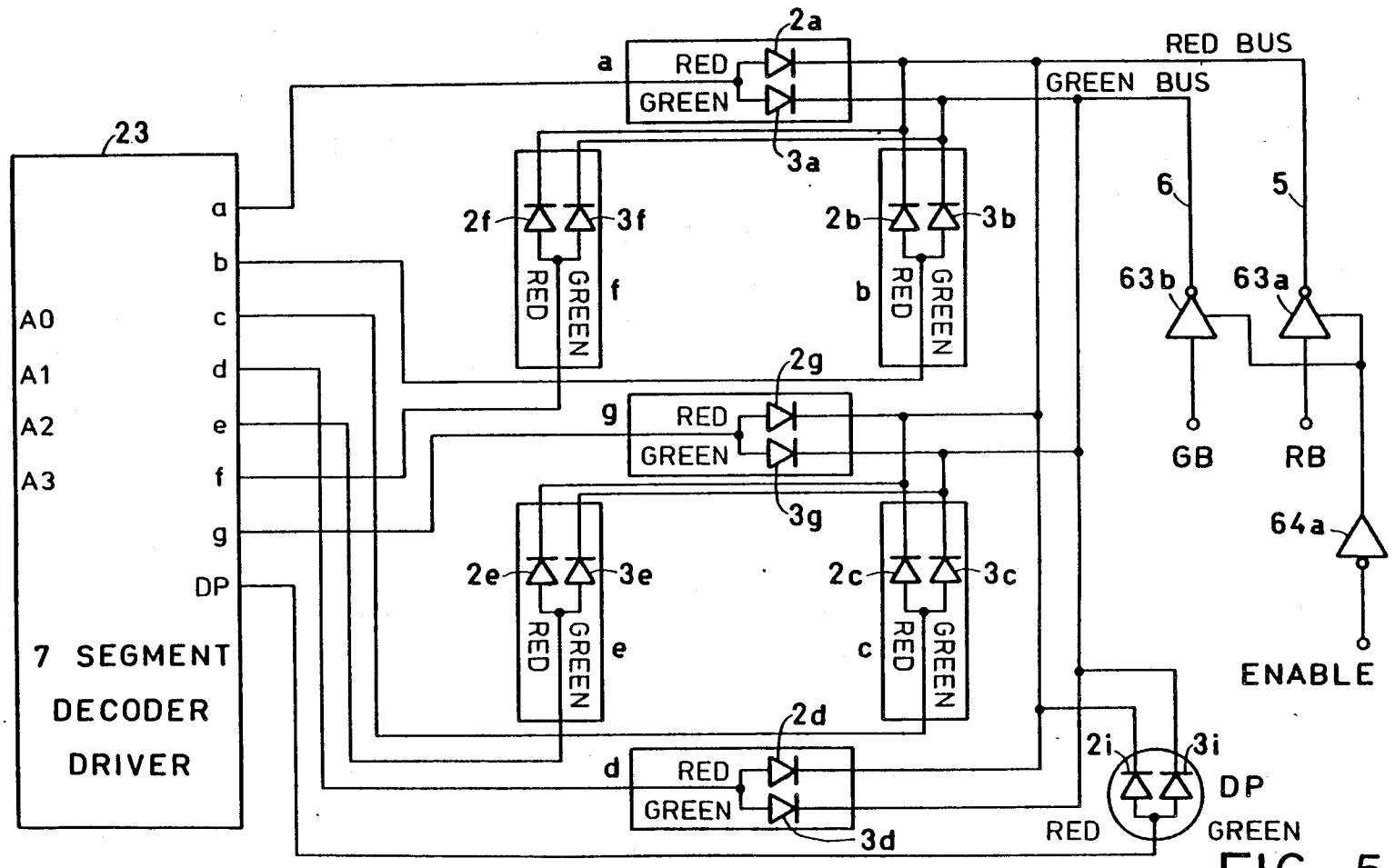
FIG. 5 is a schematic diagram of one digit of 2-primary color control circuit of this invention.

In FIG. 5 is shown a schematic diagram of a one-character 2-primary color common cathodes 7-segment display element which can selectively display various digital fonts in different colors. The anodes of all red and green LED pairs are interconnected in each display segment and are electrically connected to respective outputs of a commercially well known common-cathode 7-segment decoder driver 23. The cathodes of all red LEDs 2*a*, 2*b*, 2*c*, 2*d*, 2*e*, 2*f*, 2*g*, and 2*i* are interconnected to a common electric path referred to as a red bus 5. The cathodes of all green LEDs 3*a*, 3*b*, 3*c*, 3*d*, 3*e*, 3*f*, 3*g*, and 3*i* are interconnected to a like common electric path referred to as a green bus 6.

The red bus is connected to the output of a tri-state inverting buffer 63*a*, capable of sinking sufficient current to forwardly bias all red LEDs in the display. The green bus 6 is connected to the output of a like buffer 63*b*. The two buffers 63*a*, 63*b* can be simultaneously enabled by applying a low logic level signal to the input of the inverter 64*a*, and disabled by applying a high logic level signal therein. When the buffers 63*a*, 63*b* are enabled, the conditions of the red and green buses can be selectively controlled by applying suitable logic control signals to the bus control inputs RB (red bus) and GB (green bus), to illuminate the display in a selected color. When the buffers 63*a*, 63*b* are disabled, both red and green buses are effectively disconnected, and the display is completely extinguished.

Figure 6:
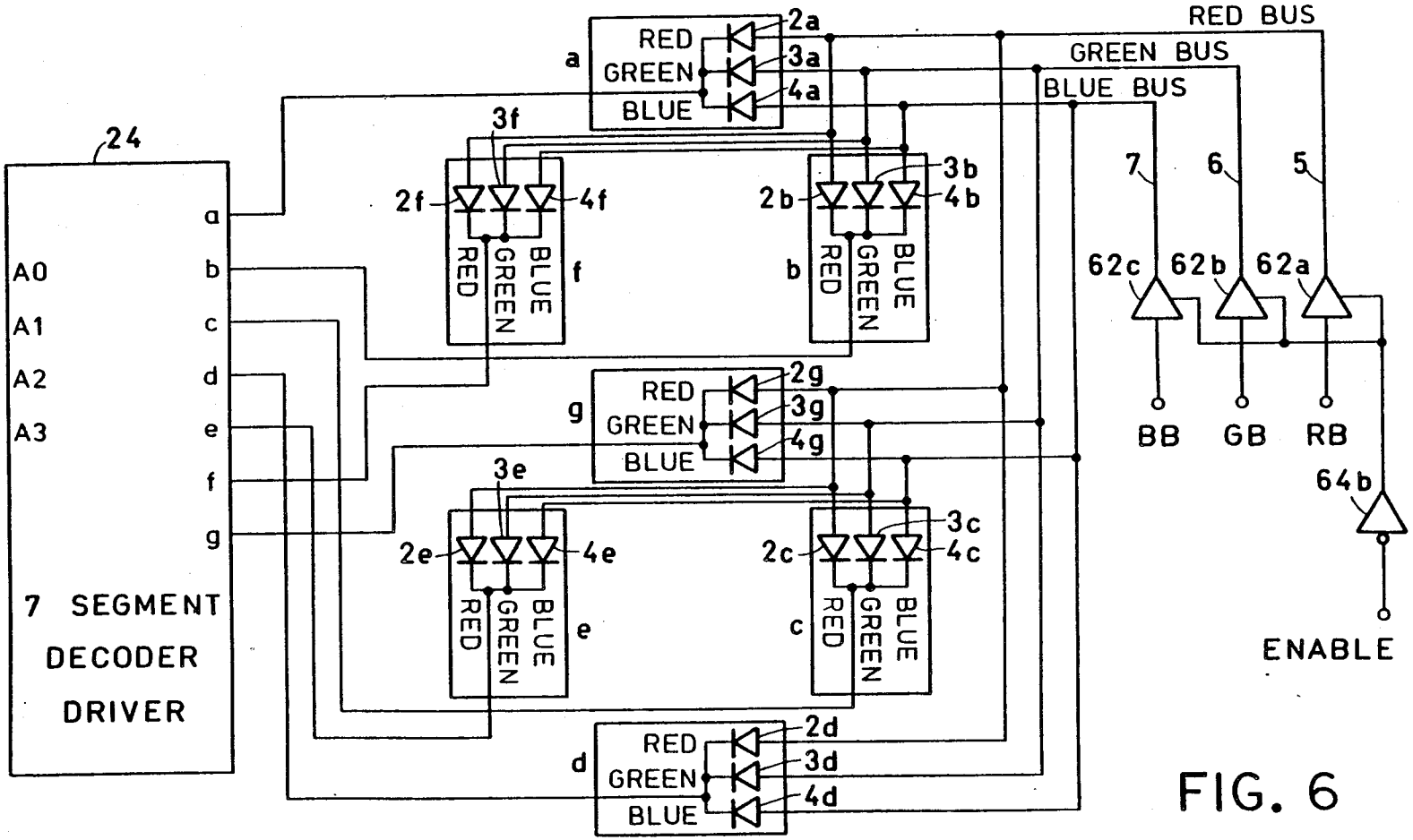
FIG. 6 is a schematic diagram of one digit of 3-primary color control circuit of this invention.

In FIG. 6 is shown a schematic diagram of a one-character 3-primary color common anodes 7-segment display element which can selectively display digital fonts in different colors. The cathodes of all red, green, and blue LED triads in each display segment are interconnected and electrically connected to respective outputs of a commercially well known common anode 7-segment decoder driver 24. The anodes of all red LEDs 2*a*, 2*b*, 2*c*, 2*d*, 2*e*, 2*f*, 2*g* are interconnected to form a common electric path referred to as a red bus 5. The anodes of all green LEDs 3*a*, 3*b*, 3*c*, 3*d*, 3*e*, 3*f*, 3*g* are interconnected to form a like common electric path referred to as a green bus 6. The anodes of all blue LEDs 4*a*, 4*b*, 4*c*, 4*d*, 4*e*, 4*f*, 4*g* are interconnected to form a like common electric path referred to as a blue bus 7.

The red bus 7 is connected to the output of a non-inverting tri-state buffer 62*a*, capable of sourcing sufficient current to illuminate all red LEDs in the display. The green bus 6 is connected to the output of a like buffer 62*b*. The blue bus 7 is connected to the output of a like buffer 62*c*. The three buffers 62*a*, 62*b*, 62*c* can be simultaneously enabled, by applying a low logic level signal to the input of the inverter 64*b*, and disabled by applying a high logic level signal therein. When the buffers 62*a*, 62*b*, 62*c* are enabled, the conditions of the red, green, and blue buses can be selectively controlled by applying suitable logic signals to the bus inputs RB (red bus), GB (green bus), and BB (blue bus), to illuminate the display in a selected color. When the buffers 62*a*, 62*b*, 62*c* are disabled, all three buses are effectively disconnected, and the display is completely extinguished.

STEP VARIABLE COLOR CONTROL

Figure 7:
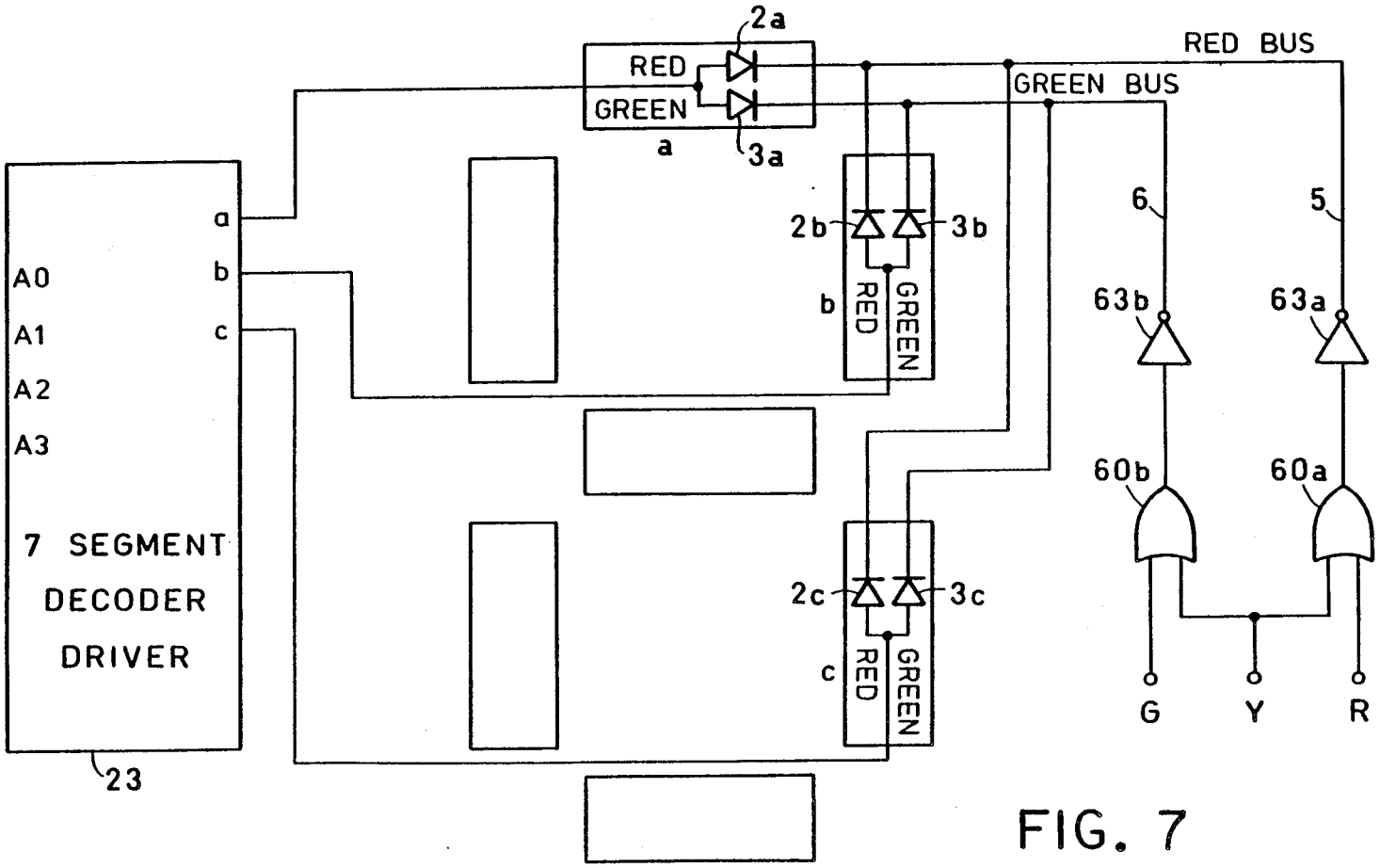
FIG. 7 is a simplified schematic diagram, similar to FIG. 5, showing how number '7' can be displayed in three different colors.

The operations of the 2-primary color 7-segment display will be now explained in detail on example of illuminating digit '7' in three different colors. A simplified schematic diagram to facilitate the explanation is shown in FIG. 7. Any digit between 0 and 9 can be selectively displayed by applying the appropriate BCD code to the inputs A0, A1, A2, A3 of the common-cathode 7-segment decoder driver 23. The decoder 23 develops at its outputs a, b, c, d, e, f, g, and DP drive signals for energizing selected groups of the segments to visually display the selected number, in a manner well known to those having ordinary skill in the art. To display decimal number '7', a BCD code 0111 is applied to the inputs A0, A1, A2, A3. The decoder 23 develops high voltage levels at its outputs , b, and c, to illuminate equally designated segments and low voltage levels at all remaining outputs (not shown), to extinguish all remaining segments.

To illuminate the display in red color, the color control input R is raised to a high logic level and color control inputs Y and G are maintained at a low logic level. As a result, the output of the OR gate 60*a* rises to a high logic level, thereby forcing the output of the buffer 63*a* to drop to a low logic level. The current flows from the output a of the decoder 23, via red LED 2*a* and red bus 5, to the current sinking output of the buffer 63*a*. Similarly, the current flows from the output b of the decoder 23, via red LED 2*b* and red bus 5, to the output of the buffer 63*a*. The current flows from the output c of the decoder 23, via red LED 2*c* and red bus 5, to the output of the buffer 63*a*. As a result, the segments a, b, c illuminate in red color, thereby causing a visual impression of a character '7'. The green LEDs 3*a*, 3*b*, 3*c* remain extinguished because the output of the buffer 63*b* is at a high logic level, thereby disabling the green bus 6.

To illuminate the display in green color, the color control input G is raised to a high logic level, while the color control inputs R and Y are maintained at a low logic level. As a result, the output of the OR gate 60*b* rises to a high logic level, thereby forcing the output of the buffer 63*b* to drop to a low logic level. The current flows from the output a of the decoder 23, via green LED 3*a* and green bus 6, to the current sinking output of the buffer 63*b*. Similarly, the current flows from the output b of the decoder 23, via green LED 3*b* and green bus 6, to the output of the buffer 63*b*. The current flows form the output c of the decoder 23, via green LED 3*c* and green bus 6, to the output of the buffer 63*b*. As a result, the segments a, b, c illuminate in green color. The red LEDs 2*a*, 2*b*, 2*c* remain extinguished because the output of the buffer 63*a* is at a high logic level, thereby disabling the red bus 5.

To illuminate the display in yellow color, the color control input Y is raised to a high logic level, while the color control inputs R and G are maintained at a low logic level. As a result, the outputs of both OR gates 61*a*, 61*b* rise to a high logic level, thereby forcing the output of both buffers 63*a*, 63*b* to drop to a low logic level. The current flows from the output a of the decoder 23, via red LED 2a and red bus 5, to the current sinking output of the buffer 63*a*, and, via green LED 3*a* and green bus 6, to the current sinking output of the buffer 63*b*. Similarly, the current flows from the output b of the decoder 23, via red LED 2*b* and red bus 5, to the output of the buffer 63*a*, and, via green LED 3*b* and green bus 6, to the output of the buffer 63*b*. The current flows from the output c of the decoder 23, via red LED 2*c* and red bus 5, to the output of the buffer 63*a*, and, via green LED 3*c* and green bus 6, to the output of the buffer 63*b*. As a result of blending light of red and green colors in each segment, the segments a, b, c illuminate in substantially yellow color.

Figure 8:
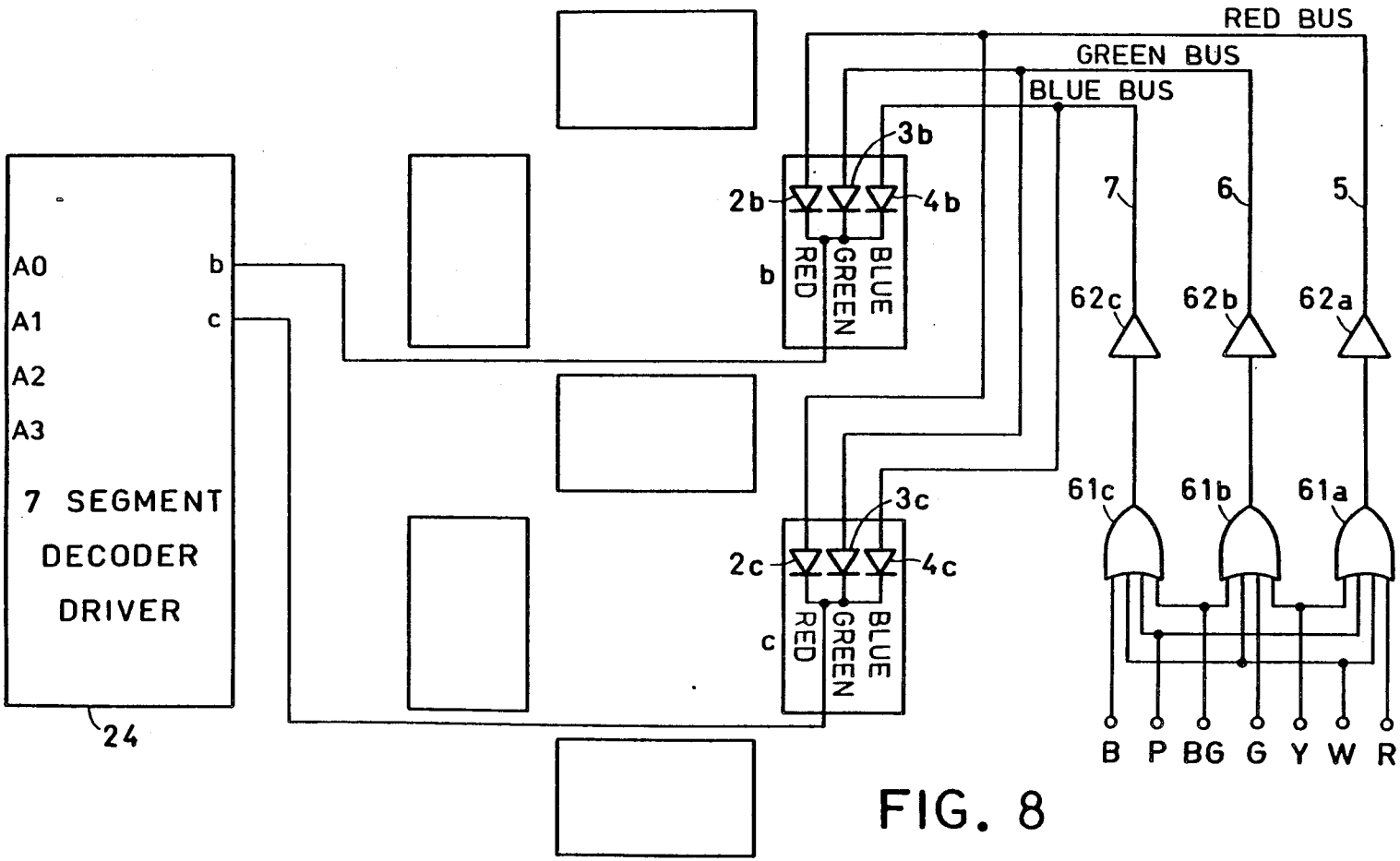
FIG. 8 is a simplified schematic diagram, similar to FIG. 6, showing how number '1' can be displayed in seven different colors.

The operation of the 3-primary color 7-segment display shown in FIG. 6 will be now explained in detail on example of illuminating digit '1' in seven different colors. A simplified schematic diagram to facilitate the explanation is shown in FIG. 8. To display decimal number '1', a BCD code 0001 is applied to the inputs A0, A1, A2, A3 of a common anode 7-segment decoder driver 24. The decoder 24 develops low voltage levels at its outputs b and c, to illuminate equally designated segments, and high voltage levels at all remaining outputs (not shown), to extinguish all remaining segments.

To illuminate the display in red color, the color control input R is raised to a high logic level, while all remaining color control inputs are maintained at a low logic level. As a result, the output of the OR gate 61*a* rises to a high logic level, thereby forcing the output of the buffer 62*a* to rise to a high logic level. The current flows from the output of the buffer 62*a*, via red bus 5 and red LED 2*b*, to the output b of the decoder 24, and, via red LED 2*c*, to the output c of the decoder 24. As a result, the segments b, c illuminate in red color, thereby causing a visual impression of a character '1'. The green LEDs 3*b*, 3*c* and blue LEDs 4*b*, 4*c* remain extinguished because the green bus 6 and blue bus 7 are disabled.

To illuminate the display in green color, the color control input G is raised to a high logic level, while all remaining color control inputs are maintained at a low logic level. As a result, the output of the OR gate 61*b* rises to a high logic level, thereby forcing the output of the buffer 62*b* to rise to a high logic level. The current flows from the output of the buffer 62*b*, via green bus 6 and green LED 3*b*, to the output b of the decoder 24, and, via green LED 3*c*, to the output c of the decoder 24. As a result, the segments b, c illuminate in green color.

To illuminate the display in blue color, the color control input B is raised to a high logic level, while all remaining color control inputs are maintained at a low logic level. As a result, the output of the OR gate 61*c* rises to a high logic level, thereby forcing the output of the buffer 62*c* to rise to a high logic level. The current flows from the output of the buffer 62*c*, via blue bus 7 and blue LED 4*b*, to the output b of the decoder 24, and, via blue LED 4*c*, to the output c of the decoder 24. As a result, the segments b, c illuminate in blue color.

To illuminate the display in yellow color, the color control input Y is raised to a high logic level, while all remaining color control inputs are maintained at a low logic level. As a result, the outputs of the OR gates 61*a*, 61*b* rise to a high logic level, thereby causing the outputs of the buffers 62*a*, 62*b* to rise to a high logic level. The current flows from the output of the buffer 62*a*, via red bus 5 and red LED 2*b*, to the output b of the decoder 24, and, via red LED 2*c*, to the output c of the decoder 24. The current also flows from the output of the buffer 62*b*, via green bus 6 and green LED 3*b*, to the output b of the decoder 24, and, via green LED 3*c*, to the output c of the decoder 24. As a result of blending light of red and green colors in each segment, the segments b, c illuminate in substantially yellow color.

To illuminate the display in purple color, the color control input P is raised to a high logic level, while all remaining color control inputs are maintained at a low logic level. As a result, the outputs of the OR gates 61*a*, 61*c* rise to a high logic level, thereby forcing the outputs of the buffers 62*a*, 62*c* to rise to a high logic level. The current flows from the output of the buffer 62*a*, via red bus 5 and red LED 2*b*, to the output b of the decoder 24, and, via red LED 2*c*, to the output c of the decoder 24. The current also flows from the output of the buffer 62*c*, via blue bus 7 and blue LED 4*b*, to the output b of the decoder 24, and, via blue LED 4*c*, to the output c of the decoder 24. As a result of blending light of red and blue colors in each segment, the segments b, c illuminate in substantially purple color.

To illuminate the display in blue-green color, the color control input GB is raised to a high logic level, while all remaining color control inputs are maintained at a low logic level. As a result, the outputs of the OR gates 61*b*, 61*c* rise to a high logic level, thereby forcing the outputs of the buffers 62*b*, 62*c* to rise to a high logic level. The current flows from the output of the buffer 62*b*, via green bus 6 and green LED 3*b*, to the output b of the decoder 24, and, via green LED 3*c*, to the output c of the decoder 24. The current also flows from the output of the buffer 62*c*, via blue bus 7 and blue LED 4*b*, to the output b of the decoder 24, and, via blue LED 4*c*, to the output c of the decoder 24. As a result of blending light of green and blue colors in each segment, the segments b, c illuminate in substantially blue-green color.

To illuminate the display in white color, the color control input W is raised to a high logic level, while all remaining color control inputs are maintained at a low logic level. As a result, the outputs of the OR gates 61*a*, 61*b*, 61*c* rise to a high logic level, thereby forcing the outputs of buffers 62*a*, 62*b*, and 62*c* to rise to a high logic level. The current flows from the output of the buffer 62*a*, via red bus 5 and red LED 2*b*, to the output b of the decoder 24, and, via red LED 2*c*, to the output c of the decoder 24. The current also flows from the output of the buffer 62*b*, via green bus 6 and green LED 3*b*, to the output b of the decoder 24, and, via green LED 3*c*, to the output c of the decoder 24. The current also flows from the output of the buffer 62*c*, via blue bus 7 and blue LED 4*b*, to the output b of the decoder 24, and, via blue LED 4*c*, to the output c of the decoder 24. As a result of blending light of red, green, and blue colors in each segment, the segments b, c illuminate in substantially white color.

Since the outputs of the 7-segment decoder 24 may be overloaded by driving a triad of LEDs in parallel in a variable color display, rather than a single LED in a monochromatic display, it would be obvious to employ suitable buffers to drive respective color display segments (not shown). It would be also obvious to provide current limiting resistors to constrain current through the LEDs (not shown).

Figure 9:
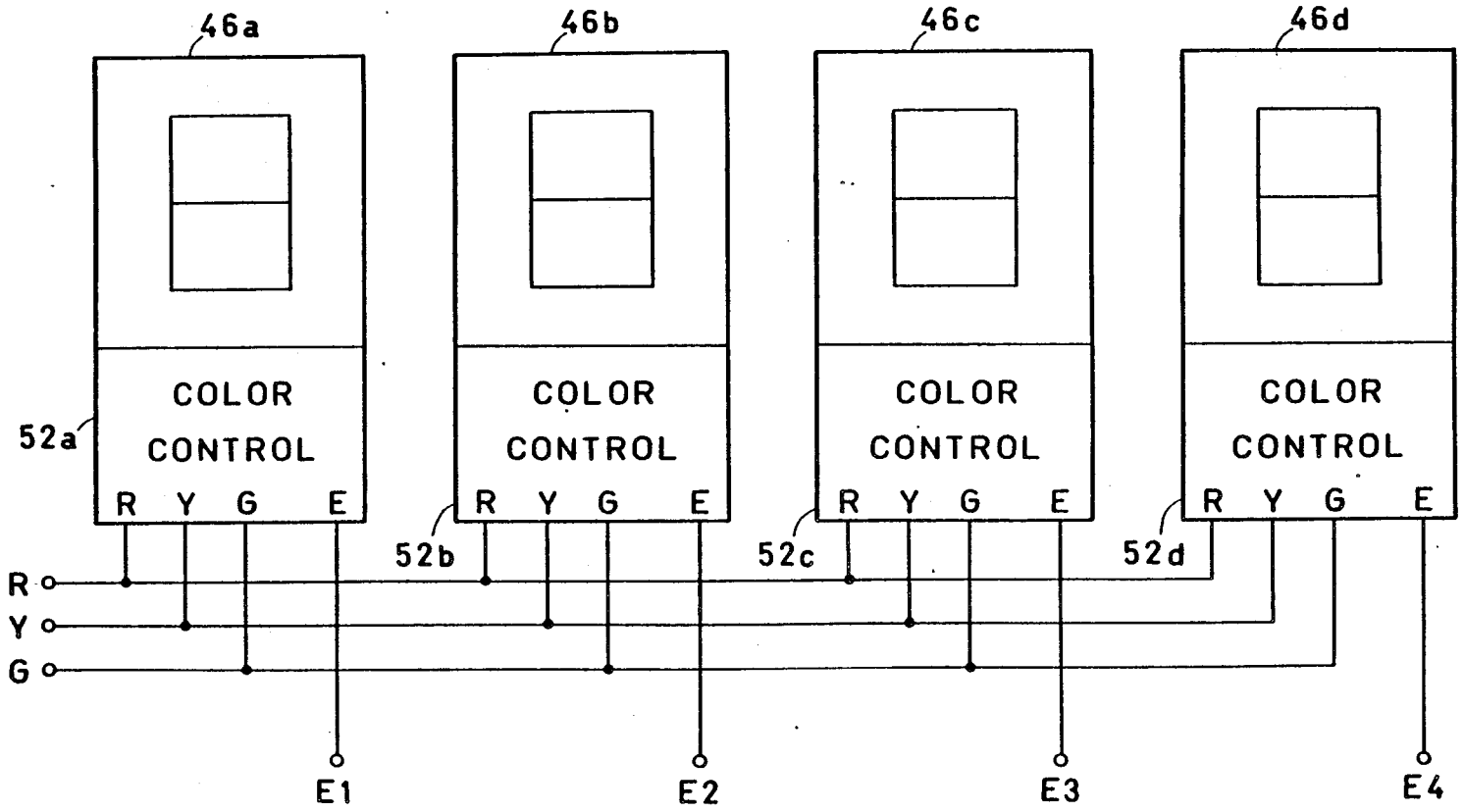
FIG. 9 is a block diagram of a multi-element 2-primary color 4-digit display.

To illustrate how the present invention can be utilized in a multi-element variable color display configuration, in FIG. 9 is shown a detail of the interconnection in a 2-primary color 4-digit display. The color control inputs R, Y, G of all display elements 46*a*, 46*b*, 46*c*, 46*d* are respectively interconnected, and the enable inputs E1, E2, E3, E4 are used to control the conditions of respective display elements. A high logic level at the enable input E will extinguish the particular display element; a low logic level therein will illuminate the element in a color determined by the instant conditions of the color control logic inputs R, Y, G.

Figure 10:
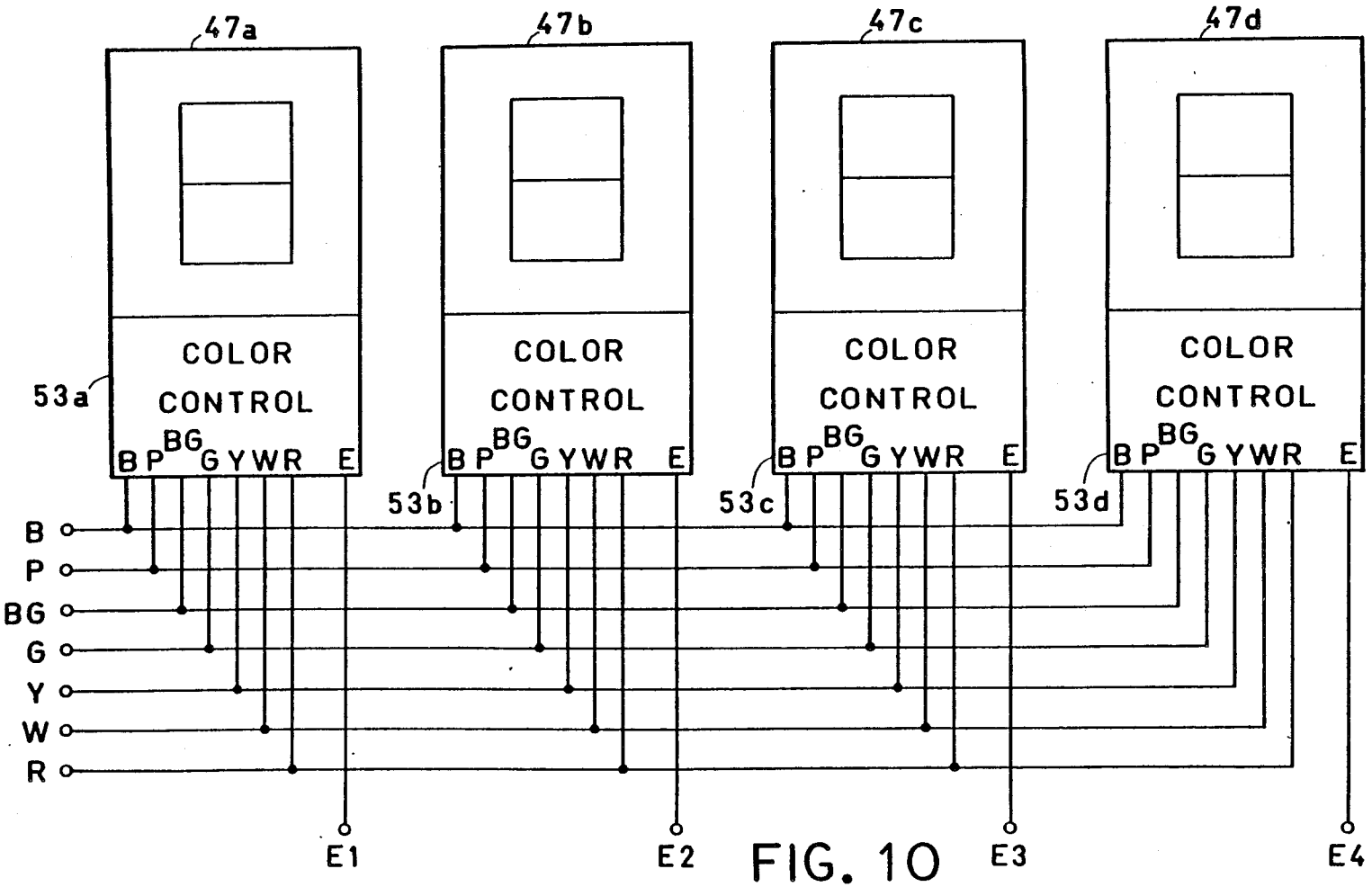
FIG. 10 is a block diagram of a multi-element 3-primary color 4-digit display.

In FIG. 10 is shown a like detail of the interconnection in a 3-primary color 4-digit display. Similarly, the color control inputs B, P, BG, G, Y, W, R or all display elements 47*a*, 47*b*, 47*c*, 47*d* are interconnected, and the conditions of respective display elements are controlled by the enable inputs E1, E2, E3, E4. A high logic level at the enable input E will extinguish the particular display element; a low logic level therein will illuminate the element in a color determined by the instant conditions of the color control logic inputs B, P, GB, G, Y, W, R.

Figure 11:
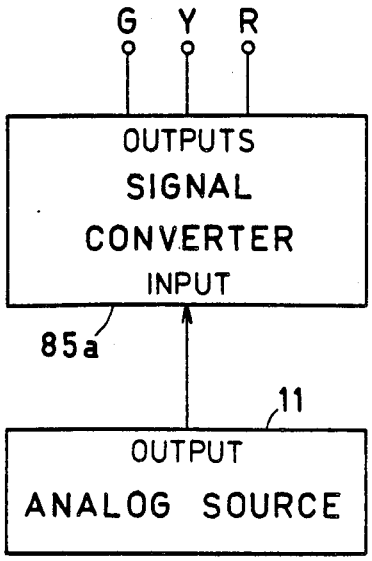
FIG. 11 is a block diagram of a signal converter for 2-primary color display.

In FIG. 11 is shown a block diagram of a signal converter for developing color control logic signals for 2-primary color display. The signal converter 85*a* accepts at its input voltage from a variable analog voltage source 11 and develops at its outputs color control logic signals R, Y, G, having relation to the magnitude of instant input analog voltage, for controlling color of the variable color display, shown in FIG. 5, in accordance with the magnitude of input voltage.

Figure 12:
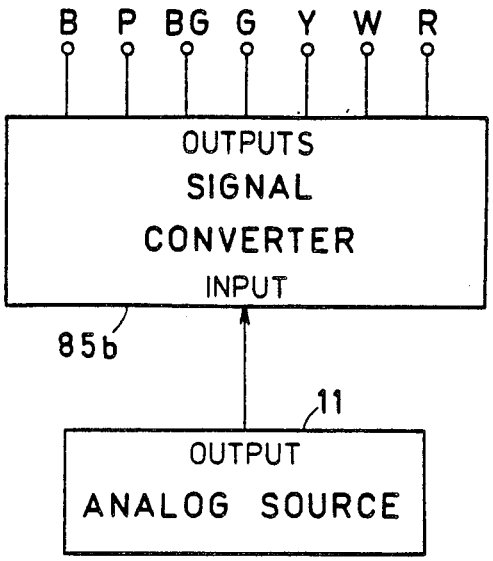
FIG. 12 is a block diagram of a signal converter for 3-primary color display.

In FIG. 12 is shown a block diagram of a like signal converter for developing color control logic signals for 3-primary color display. The signal converter 85*b* accepts at its input voltage from a source 11 and develops output color control logic signals B, P, BG, G, Y, W, R, related to the magnitude of instant input analog voltage, for controlling the color of the variable color display, shown in FIG. 6, in accordance with the magnitude of input voltage.

Figure 13:
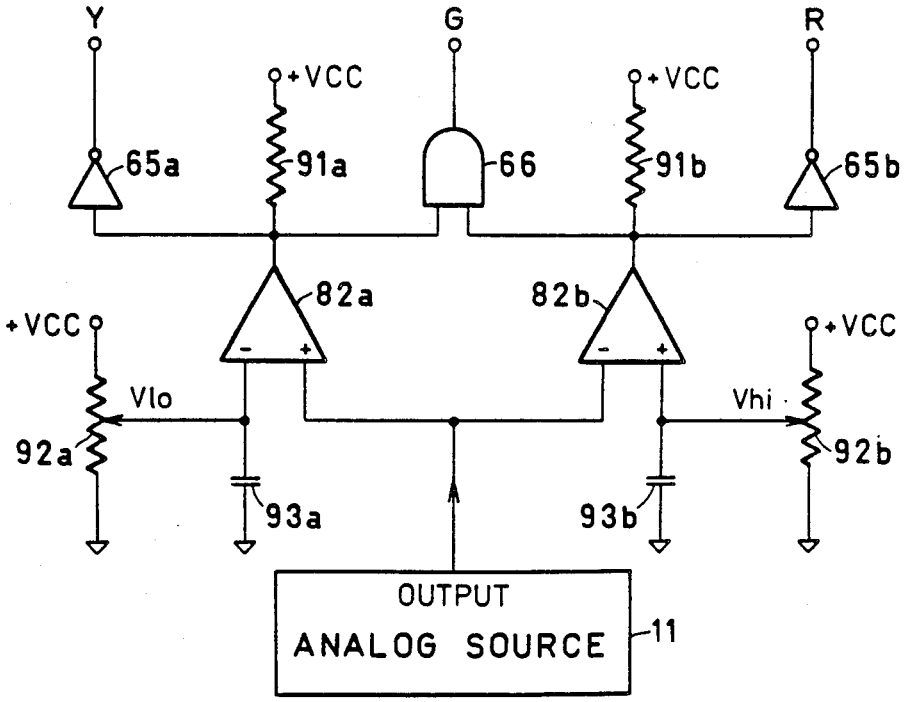
FIG. 13 is a schematic diagram of a comparator circuit for 2-primary color display.

In FIG. 13, the output voltage of a variable analog voltage source 11 is applied to the interconnected inputs of two analog comparators 82*a*, 82*b*, in a classic 'window' comparator configuration. When the voltage developed by the source 11 is lower than the low voltage limit Vlo, set by a potentiometer 92*a*, the output of the comparator 82*a* drops to a low logic level, thereby forcing the output of the inverter 65*a* to rise to a high logic level, to activate the color control logic input Y of the display element, shown in FIG. 5, for illuminating the display in yellow color.

When the voltage developed by the source 11 is higher than the high voltage limit Vhi, set by a potentiometer 92*b*, the output of the comparator 82*b* drops to a low logic level, thereby forcing the output of the inverter 65*b* to rise to a high logic level, to activate the color control logic input R for illuminating the display in red color.

When the voltage developed by the source 11 is between the low voltage limit Vlo and high voltage limit Vhi, the outputs of the comparators 82*a*, 82*b* rise to a high logic level, thereby causing the output of the AND gate 66 to rise to a high logic level, to activate the color control logic input G, for illuminating the display in green color.

Figure 14:
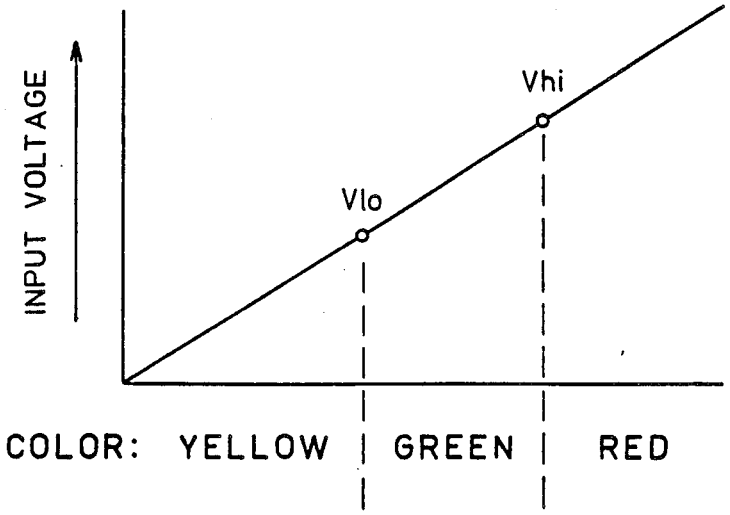
FIG. 14 is a graph showing the relationship between the inputs and outputs of the comparator circuit in FIG. 13.

FIG. 14 is a graph depicting the relationship between the input voltage of the comparator circuit shown in FIG. 13 and the color of the display element shown in FIG. 5. The display element illuminates in yellow color for input voltage lower than the limit Vlo, in green color for input voltage between the limits Vlo and Vhi, and in red color for input voltage higher than the limit Vhi.

Figure 15:
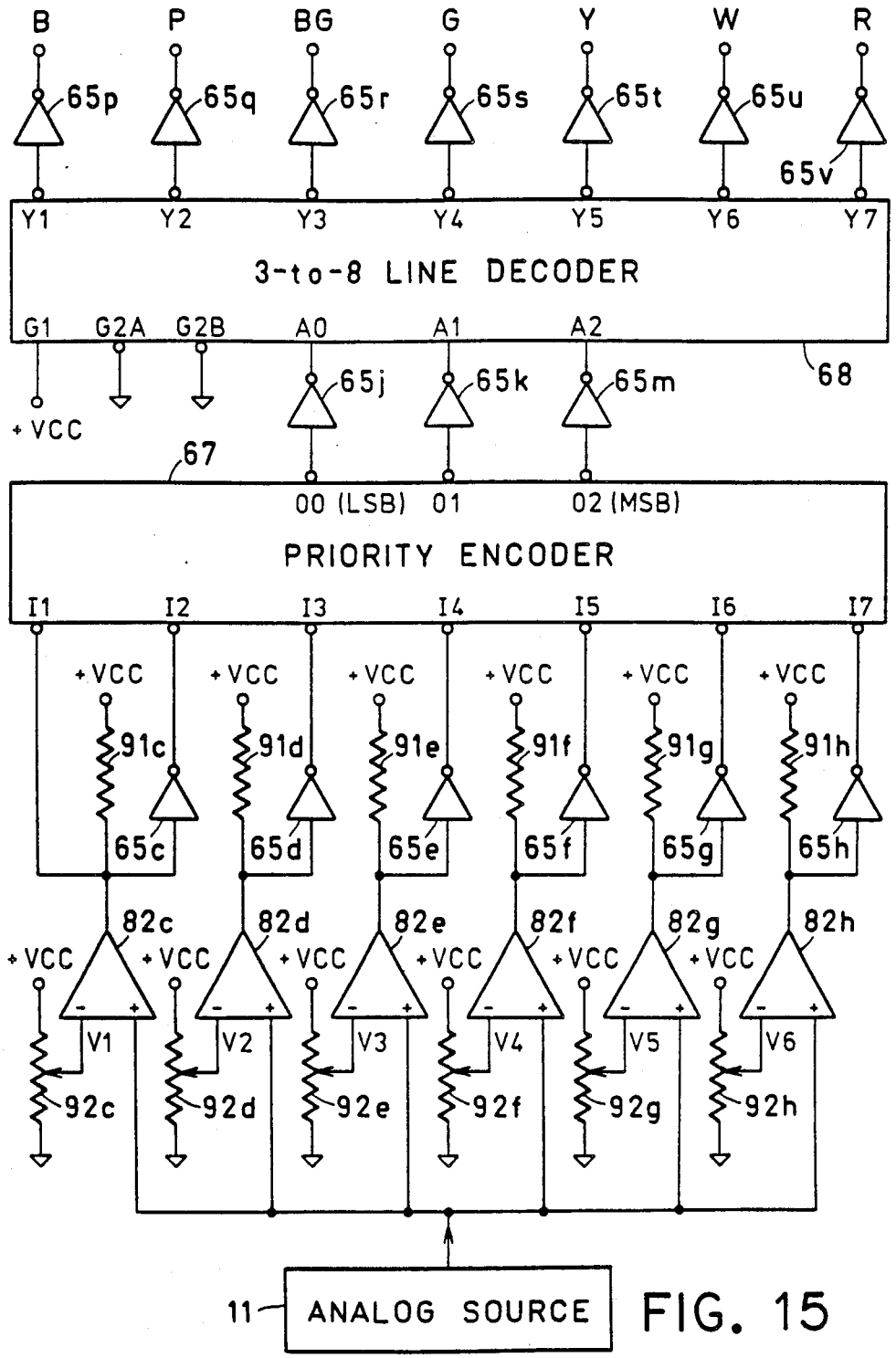
FIG. 15 is a schematic diagram of a comparator circuit for 3-primary color display.

In FIG. 15, the output voltage of a variable analog voltage source 11 is applied to the interconnected '+' inputs of six analog comparators 82*c*, 82*d*, 82*e*, 82*f*, 82*g*, 82*h*, connected in a well known 'multiple aperture window' configuration. There are six progressively increasing voltage limits V1 to V6, set by respective potentiometers 92*c* to 92*h*. The outputs of the comparators 82*c* to 82*h* are respectively connected, via inverters 65*c* to 65*h*, to the inputs 11 to 17 of a priority encoder 67. Each of the inputs I1 to I7 has assigned a certain priority (from I1 being the lowest priority progressively to I7 being the highest one). The priority encoder 67 develops at its outputs 00, 01, 02 a code identifying the highest priority input activated. The outputs of the encoder 67 are respectively connected, via inverters 65*j* to 65*m*, to the inputs A0, A1, A2 of a 3-to-8 line decoder 68, to decode the outputs of the encoder 67 into seven mutually exclusive active logic low outputs Y1 to Y7. The outputs Y1 to Y7 are respectively connected, via inverters 65*p* to 65*v*, to the color control logic inputs B, P, BG, G, Y, W, R of the display element shown in FIG. 6.

When output voltage of the source 11 is lower than the lowest voltage limit V1, the output of the comparator 82*c* drops to a low logic level, thereby activating the input I1 of the priority encoder 67. The code 110 developed at the outputs 00, 01, 02 is inverted by the inverters 65*j* to 65*m* to yield the code 001 which produces a low logic level at the output Y1, to force, via inverter 65*p*, the color control logic input B to a high logic level. The display illuminates in blue color.

When output voltage of the source 11 is between the adjacent voltage limits, e. g., V4 and V5, the output of the comparator 82*f* rises to a high logic level, thereby activating the input I5 of the priority encoder 67. The code 100 developed at the inputs of the decoder 68 produces a high logic level at the color control logic input Y. The display illuminates in yellow color.

Figure 16:
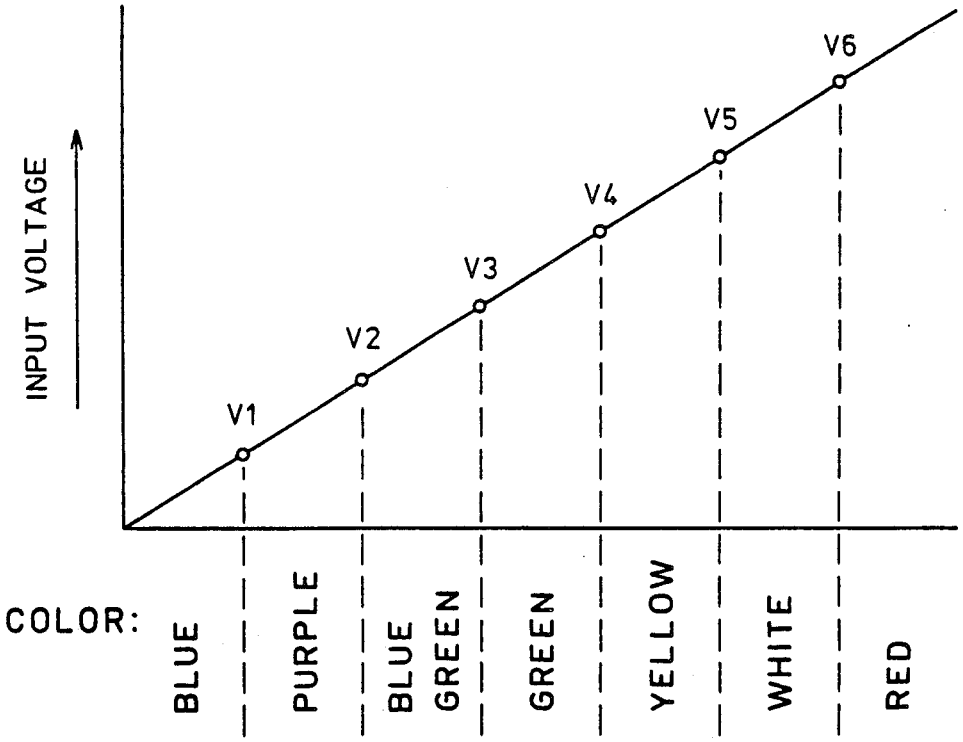
FIG. 16 is a graph showing the relationship between the inputs and outputs of the comparator circuit in FIG. 15.

FIG. 16 is a graph depicting the relationship between the input voltage of the comparator circuit shown in FIG. 15 and the color of the display element shown in FIG. 6. The display element illuminates in blue color for input voltage lower than the limit V1, in purple color for input voltage between the limits V1 and V2, in blue-green color for input voltage between the limits V2 and V3, in green color for input voltage between the limits V3 and V4, in yellow color for input voltage between the limits V4 and V5, in white color for input voltage between the limits V5 and V6, and in red color for input voltage higher than the limit V6.

It would be obvious to those having ordinary skill in the art, in the view of this disclosure, that the color sequences could be readily changed by differently interconnecting the outputs of the comparator circuit with color control logic inputs of the display element.

TIMEPIECE

Figure 17:
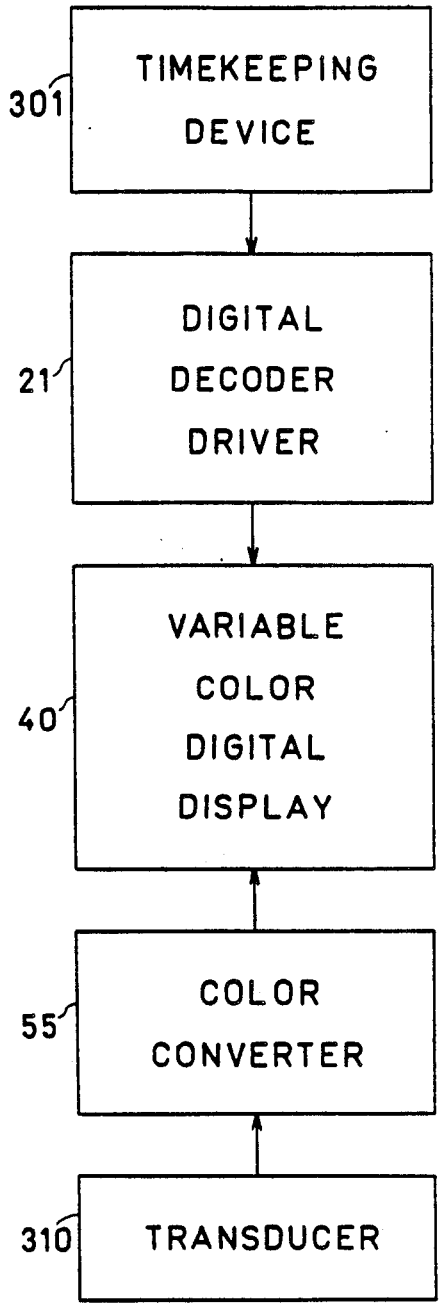
FIG. 17 is a block diagram of a timepiece with variable color digital display and a transducer.

FIG. 17 is a generalized block diagram of a timepiece with transducer of this invention which includes a timekeeping device 301 for keeping time and for developing output electrical signals indicative of time, a digital decoder driver 21 for converting output electrical signals of the timekeeping device into a displayable code, and variable color digital display 40 for indicating time in digital format. The invention resides in the addition of a transducer 310, for measuring a physical quantity and for developing output electrical signals related to values of such physical quantity, and of a color converter circuit 55, for converting output electrical signals of the transducer 310 to color control signals for controlling the color of the display 40. The display 40 will thus simultaneously indicate time, in digital format, and values of the measured physical quantity, in variable color.

The timekeeping device 301 typically contains a high frequency accurate time standard signal generator and a chain of frequency dividers for providing highly stable clock signal of 1 Hz frequency which drives the seconds, minutes, and hours counters (not shown). The digital decoder driver 21 continuously converts output signals of such counters to suitable codes for driving multi-digit display 40, in a manner well understood by those skilled in the art.

Figure 18:
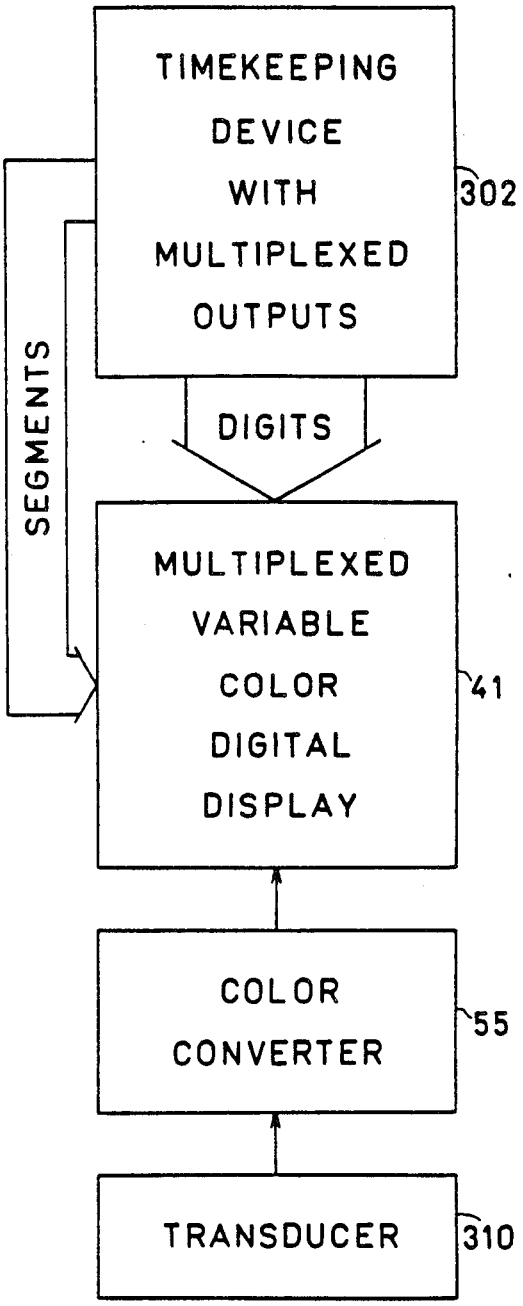
FIG. 18 is a block diagram of a like timepiece characterized by multiplexed outputs.

In FIG. 18 is shown a block diagram of a like timepiece 302 having multiplexed outputs which can be directly coupled to a multiplexed variable color display 41.

The term transducer, as used throughout the description of the invention, is used in its widest sense so as to include every type of a device for performing a conversion of one type of energy to another. The principles of the invention may be applied to various displacement, motion, force, pressure, sound, flow, temperature, humidity, weight, magnetic, and like transducers. A physical transducer is defined for the purpose of this invention as means for measuring values of a physical quantity and for developing output electrical signals related to values of the measured physical quantity.

Figure 19:
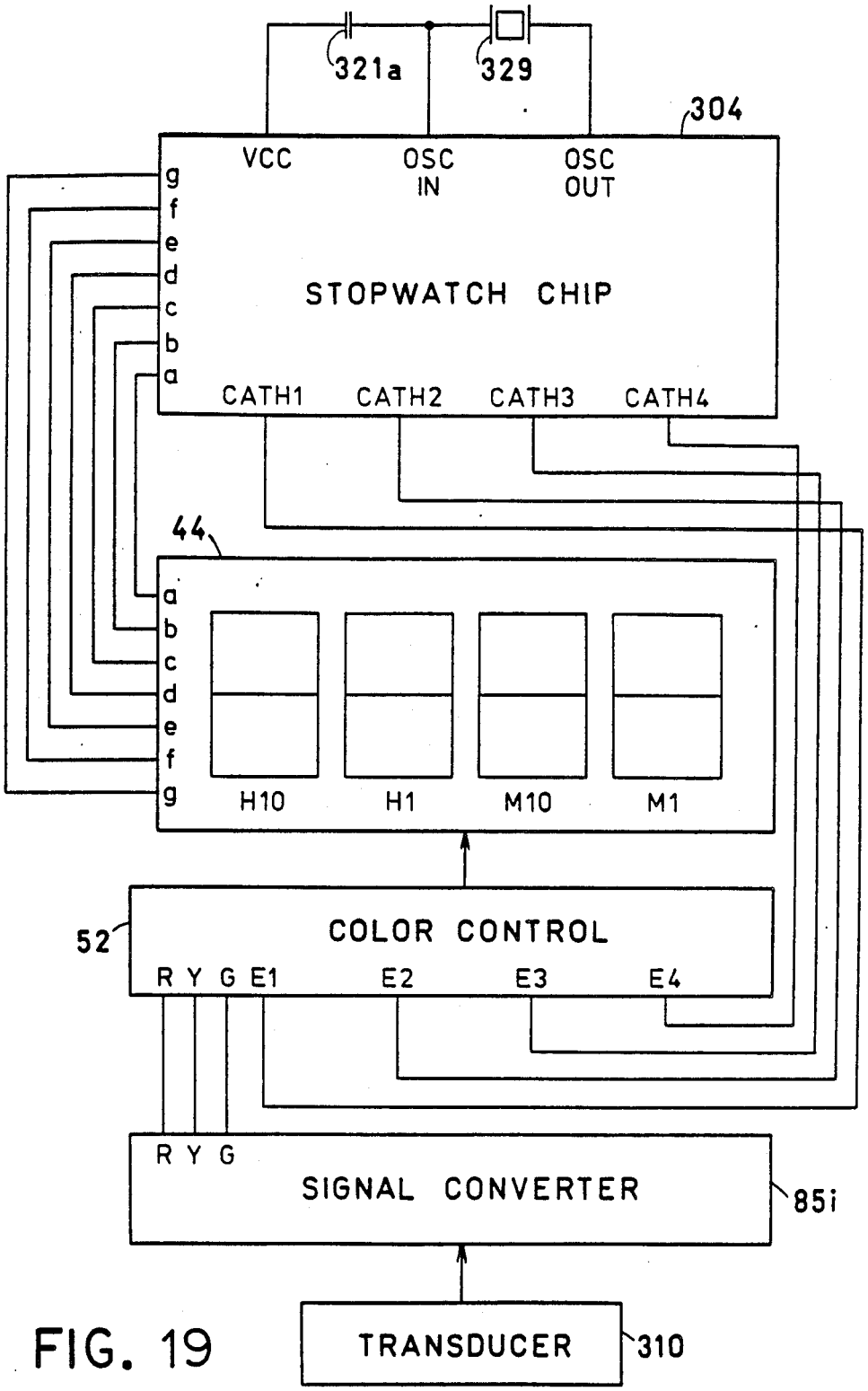
FIG. 19 is an expanded block diagram of a timepiece with variable color digital display and 3-step color control for all display digits.

A timepiece shown in a schematic diagram of FIG. 19 includes a stopwatch chip 304 for developing multiplexed segment drive signals a, b, c, d, e, f, and g to directly drive a 4-digit 2-LED variable color digital display 44, which will indicate time in hours (on digits H10 and H1) and minutes (on digits M10 and M1), in a manner well understood by those skilled in the art. The multiplexing enable signals Cath1, Cath2, Cath3, and Cath4 are utilized to sequentially enable respective digits of the display 44, as shown in the detail inFIG. 9, at a relatively fast rate, to provide a flick-free display in a color determined by the instant conditions of the color control inputs R, Y, and G.

The invention resides in the additio of a transducer 310, for developing electrical signals related to values of the measured physical quantity, and a signal converter 85i, for converting the transducer's output electrical signals to color control signals R, Y, and G, as shown in the detail in FIGS. 11 and 13, to control the color of the display 44 in three steps in accordance with values of the measured physical quantity.

Figure 20:
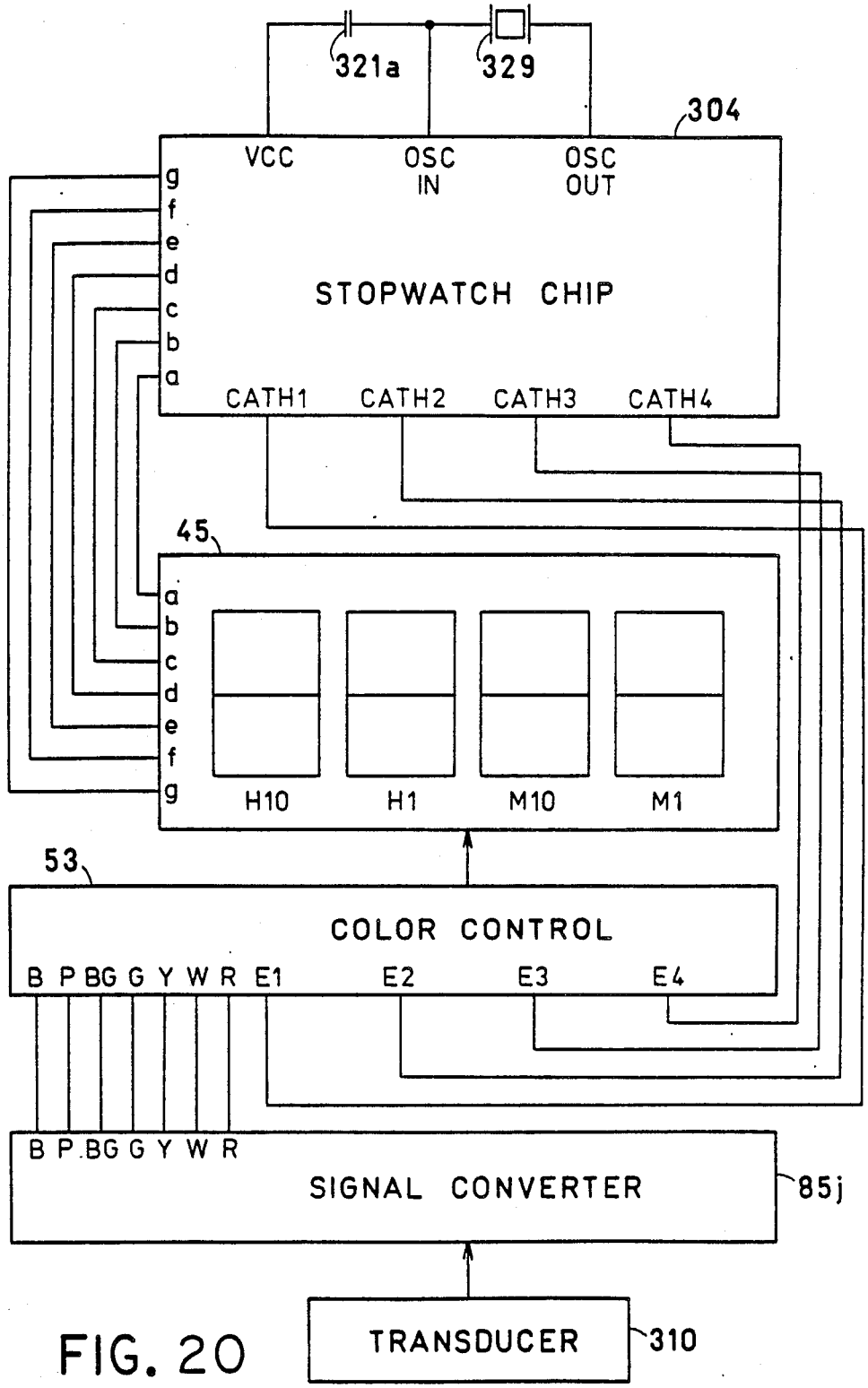
FIG. 20 is an expanded block diagram of a like timepiece with 7-step color control for all display digits.

In FIG. 20 is shown a like schematic diagram of a timepiece, which differs from the one shown in FIG. 19 in that a 4-digit 3-LED variable color digital display 45 and a signal converter **85*j* are utilized for converting the transducer's output electrical signals to color control signals, B, P, BG, G, Y, W, and R, as shown in the detail in FIGS. 12 and 15, to control the color of the display 45 in seven steps in accordance with values of the measured physical quantity. The detail of the interconnection of the four display digits is shown in FIG. 10**.

Figure 21:
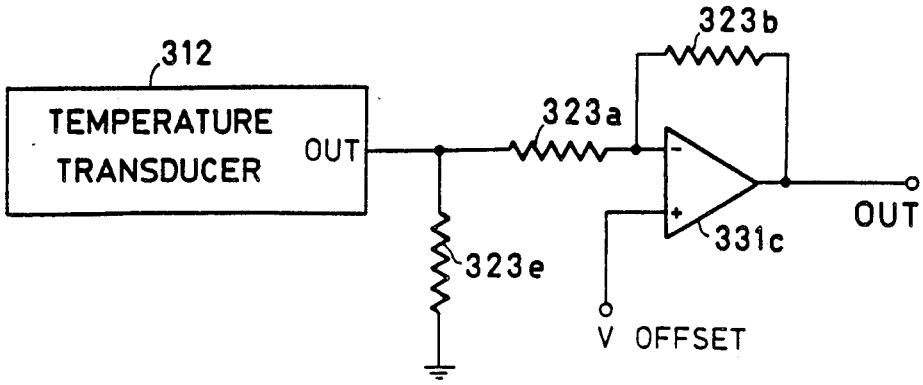
FIG. 21 is a schematic diagram of a temperature transducer with interface circuit.

In a schematic diagram shown in FIG. 21, temperature transducer 312 measures ambient temperature and develops at its output a current which is linearly proportional to measured temperature in degrees Kelvin. The current flows through a resistor **323*e* of suitable value (e. g., 1 k Ohm), to develop voltage proportional to the measured temperature, which is applied to the input of an op amp 331*c* having a feedback established by resistors 323*a*, 323*b*. To read at the op amp's outputs OUT voltage that directly corresponds to temperature in degrees Celsius, the other input of the op amp is offset by 273.2 mV. The invention resides in utilizing the output voltage at the terminal OUT to develop color control signals for causing the display to illuminate in a color related to the measured ambient temperature. To achieve this, the terminal OUT may be connected as shown in the detail either in FIG. 13, to control the color of the display in three steps, or in FIG. 15**, to control the color of the display in seven steps.

Figure 22:
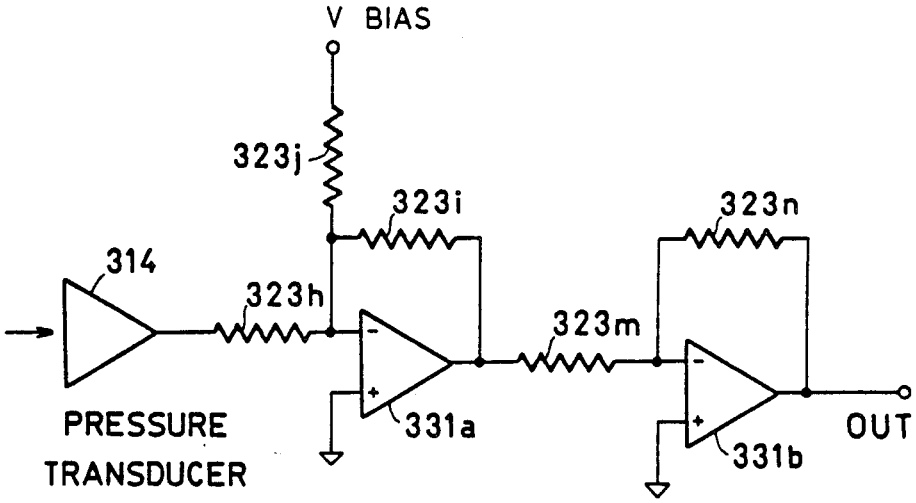
FIG. 22 is a schematic diagram of an atmospheric pressure transducer with interface circuit.

In a schematic diagram shown in FIG. 22, pressure transducer 314 measures atmospheric pressure and develops at its output a voltage which is linearly proportional to the measured atmospheric pressure. The scaling circuit consisting of two op amps **331*a* and 331*b* with associated resistors 323*h* to 323*n* scales the transducer's output voltage, in a manner well understood by those skilled in the art, such that the resulting voltage at the terminal OUT directly corresponds to the measured atmospheric pressure, either in milibars or in mm Hg, depending on the selection of certain resistors. The invention resides in utilizing the output voltage at the terminal OUT for causing the display to illuminate in a color related to the measured atmospheric pressure. The terminal OUT may be connected as shown in FIGS. 13 or 15**.

Although not shown in the drawings, it will be appreciated that the timepiece of this invention may have any conceivable form or shape, such as a wrist watch, pocket watch, clock, alarm clock, and the like. Alternatively, the timepiece may have characteristics of an article for wearing on a body of wearer or for securing to wearer's clothin, such as a bracelet, ring, ear-ring, necklace, tie tack, button, cuff link, brooch, hair ornament, and the like, or it may be built into, or associated with, an object such as apen, pencil, ruler, lighter, briefcase, purse, and the like.

In brief summary, the invention describes a method of simultaneously displaying values of time and values of a physical quantity, on a display device including a plurality of variable color display elements, by causing values of time to be indicated in a character format, and by controlling color of the display in accordance with values of the physical quantity.

A timepiece with a variable color digital display for indicating time in a character format was disclosed which includes a physical transducer for measuring values of a physical quantity, such as temperature or atmospheric pressure. Color control responsive to output signals of the physical transducer is provided for controlling color of the display in accordance with measured values of the physical quantity.

All matter herein described and illustrated in the accompanying drawings should be interpreted as illustrative and not in a limiting sense. It would be obvious that numerous modifications can be made in the construction of the preferred embodiments shown herein, without departing from the spirit of the invention as defined in the appended claims. It is contemplated that the principles of the invention may be also applied to numerous diverse types of display devices, such are liquid crystal, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 2 | red LED | |
| 3 | green LED | |
| 4 | blue LED | |
| 5 | red bus | |
| 6 | green bus | |
| 7 | blue bus | |
| 11 | analog voltage source | |
| 15 | segment body | |
| 16 | light scattering material | |
| 20 | decoder | |
| 21 | digital decoder driver | |
| 23 | common cathode 7-segment decoder | 74LS49 |
| 24 | common anode 7-segment decoder | 74LS47 |
| 40 | variable color digital display | |
| 41 | multiplexed variable color display | |
| 44 | 4-digit variable color display (2 LEDs) | |
| 45 | 4-digit variable color display (3 LEDs) | |
| 46 | one variable color display character (2 LEDs) | |
| 47 | one variable color display character (3 LEDs) | |
| 50 | color control | |
| 51 | step variable color control | |
| 52 | color control (2 LEDs) | |
| 53 | color control (3 LEDs) | |
| 55 | color converter | |
| 60 | 2-input OR gate | 74HC32 |
| 61 | 4-input OR gate | 4072 |
| 62 | non-inverting buffer | 74LS244 |
| 63 | inverting buffer | 74LS240 |
| 64 | inverter | part of 74LS240,4 |
| 65 | inverter | 74HC04 |
| 66 | 2-input AND gate | 74HC08 |
| 67 | priority encoder | 74HC147 |
| 68 | 3-to-8 line decoder | 74HC138 |
| 71 | 8-bit counter | 74F579 |
| 82 | analog comparator | LM339 |
| 85 | signal converter | |
| 91 | resistor | |
| 92 | potentiometer | |
| 93 | capacitor | |
| 301 | timekeeping device | |
| 302 | timekeeping device with multiplexed display | |
| 304 | Intersil stopwatch chip | ICM7045 |
| 310 | transducer | |
| 312 | Analog Devices temperature transducer | AD590J |
| 314 | SenSym atmospheric pressure transducer | LX1802AN |
| 321 | capacitor | |
| 323 | resistor | |
| 325 | potentiometer | |
| 329 | crystal | |
| 331 | op amp | LM741 |

What I claim is:

1. The method of simultaneously indicating values of time and values of a physical quantity, on a single variable color digital display means, by cuasing a digital indication of time to be exhibited on said display means and by controlling the color of said digital indication in accordance with the values of said physical quantity.

2. A timepiece comprising:

timekeeping means;

variable color digital display means for providing a digital indication of time;

physical transducer means for measuring a physical quantity and for developing output electrical signals related to the values of said physical quantity; and color control means responsive to said output electrical signals of said physical transducer means for controlling the color of said digital indication in accordance with the values of said physical quantity.

3. A timepiece comprising:

timekeeping means;

variable color digital display means for providing a digital indication of time;

temperature transducer means for measuring temperature and for developing output electrical signals related to the values of temperature; and color control means responsive to said output electrical signals of said temperature transducer means for controlling the color of said digital indication in accordance with the values of temperature.

4. A timepiece as defined in claim 3 more characterized by:

said temperature transducer means including comparison means for effecting a comparison of measured value of temperature with a plurality of respectively different predetermined limits to determine the range in which the measured value of temperature lies, and for developing comparison signals accordingly; and said color control means being responsive to said comparison signals for controlling color of said display means in a plurality of steps such that its color corresponds to the range in which the measured value of temperature lies.

5. A timepiece as defined in claim 3 more characterized by:

said temperature transducer means including comparison means for effecting a comparison of measured value of temperature with a low and high predetermined limits to determine whether the measured value of temperature is lower than said low predetermined limit, or higher than said high predetermined limit, or within the bounds of said low and high predetermined limits, and for developing comparison signals accordingly; and said color control means being responsive to said comparison signals for illuminating said display means in a first color when the measured value of temperature is lower than said low predetermined limit, in a second color when the measured value of temperature is higher than said predetermined limit, and in a third color when the measured value of temperature is within the bounds of said low and high predetermined limits, said first, second, and third colors being respectively different.

6. A timepiece as defined in claim 3 more characterized by:

said temperature transducer means including comparison means for effecting a comparison of measured value of temperature with six progressively increasing predetermined limits, defining seven ranges, to determine in which one of said seven ranges the measured value of temperature lies, and for developing comparison signals accordingly; and said color control means being responsive to said comparison signals for illuminating said display means in one of seven respectively different color according to the range in which the measured value of temperature lies.

7. A timepiece comprising:

timekeeping means;

variable color character display means for indicating time in a character format;

atmospheric pressure transducer means for measuring atmospheric pressure and for developing output electrical signals related to values of atmospheric pressure; and color control means responsive to said output electrical signals of said atmospheric pressure transducer means for controlling color of said display means in accordance with values of atmospheric pressure.

8. A timepiece as defined in claim 7 more characterized by:

said atmospheric pressure transducer means including comparison means for effecting a comparison of measured value of atmospheric pressure with a plurality of respectively different predetermined limits to determine the range in which the measured value of atmospheric pressure lies, and for developing comparison signals accordingly; and said color control means being responsive to said comparison signals for controlling color of said display means in a plurality of steps such that its color corresponds to the range in which the measured value of atmospheric pressure lies.

9. A timepiece as defined in claim 7 more characterized by:

said atmospheric pressure transducer means including comparison means for effecting a comparison of measured value of atmospheric pressure with a low and high predetermined limits to determine whether the measured value of atmospheric pressure is lower than said low predetermined limit, or higher than said high predetermined limit, or within the bounds of said low and high predetermined limits, and for developing comparison signals accordingly; and said color control means being responsive to said comparison signals for illuminating said display means in a first color when the measured value of atmospheric pressure is lower than said low predetermined limit, in a second color when the measured value of atmospheric pressure is higher than said high predetermined limit, and in a third color when the measured value of atmospheric pressure is within the bounds of said low and high predetermined limits, said first, second, and third colors being respectively different.

10. A timepiece as defined in claim 7 more characterized by:

said atmospheric pressure transducer means including comparison means for effecting a comparison of measured value of atmospheric pressure with six progressively increasing predetermined limits, defining seven ranges, to determine in which one of said seven ranges the measured value of atmospheric pressure lies, and for developing comparison signals accordingly; and said color control means being responsive to said comparison signals for illuminating said display means in one of seven respectively different colors according to the range in which the measured value of atmospheric pressure lies.

11. The method of simultaneously indicating values of time and values of temperature, on a single variable color digital display means, by causing a digital indication of time to be exhibited on said display means and by controlling the color of said digital indication in accordance with the values of temperature.

* * * * *